US006545232B1

(12) United States Patent
Huo-Lu

(10) Patent No.: US 6,545,232 B1
(45) Date of Patent: Apr. 8, 2003

(54) THIN LIGHT PERMEABLE KEYBOARD MULTIPLE SWITCH ASSEMBLY INCLUDING SCISSORS TYPE ACTUATOR MECHANISMS

(75) Inventor: Tsai Huo-Lu, Taichung Hsien (TW)

(73) Assignee: Sunrex Technology Corp. (TW)

( * ) Notice: Subject to any disclaimer, the term of this patent is extended or adjusted under 35 U.S.C. 154(b) by 0 days.

(21) Appl. No.: 09/989,854

(22) Filed: Nov. 20, 2001

(51) Int. Cl.[7] ..... H01H 13/705; H01H 9/02

(52) U.S. Cl. ..... 200/5 A; 200/314; 200/344; 200/517; 200/310

(58) Field of Search ..... 200/5 A, 512–517, 200/308–317, 344; 361/679–681; 341/22–35

(56) References Cited

U.S. PATENT DOCUMENTS 4,022,993 A * 5/1977 Shattuck ..... 200/5 A
4,024,368 A * 5/1977 Shattuck ..... 200/314
5,278,372 A * 1/1994 Takagi et al. ..... 200/344
5,568,367 A * 10/1996 Park ..... 200/314 X
5,635,927 A * 6/1997 Lin ..... 200/311 X
5,767,468 A * 6/1998 Tsai ..... 200/344
5,911,317 A * 6/1999 Tsai ..... 200/314 X
6,217,183 B1 * 4/2001 Shipman ..... 200/314 X
6,284,988 B1 * 9/2001 Watanabe et al. ..... 200/5 A
6,340,803 B1 * 1/2002 Li ..... 200/344

* cited by examiner

*Primary Examiner*—J. R. Scott
(74) *Attorney, Agent, or Firm*—Connolly Bove Lodge & Hutz

(57) ABSTRACT

A thin type light permeable keyboard includes a plurality of keys, a plurality of bridge structures, a frame board, a luminescence board, a film circuit board, and a base board. Each of the light permeable keys has a top face in turn coated with a light permeable substrate layer, a light impermeable coating layer, and a light permeable protection layer. Each of the bridge structures is pivoted between each of the keys and the frame board. The luminescence board mounted between the frame board and the film circuit board may function as a luminous member that may mate with the light permeable frame board, elastic members and keys to indicate the sculptured characters, symbols, numbers or patterns on the keys, thereby facilitating the user operating the computer in the dark site.

7 Claims, 3 Drawing Sheets

THIN LIGHT PERMEABLE KEYBOARD MULTIPLE SWITCH ASSEMBLY INCLUDING SCISSORS TYPE ACTUATOR MECHANISMS

BACKGROUND OF THE INVENTION

1. Field of the Invention

The present invention relates to a thin type light permeable keyboard, and more particularly to a thin type light permeable keyboard which may be used in a dark site.

2. Description of the Related Art

The keyboard of a notebook computer may use a thin type press button structure that includes a scissors-type or bridge-type support structure mounted between the key and the base board. The linking mechanism of the scissors-type or bridge-type support structure is disclosed in U.S. Pat. No. 5,278,372 and U.S. Pat. No. 5,767,468. Thus, the keyboard structure has a thin volume, has a light weight, and may be operated exactly. However, the keyboard is not provided with a light permeable structure to aid illumination, so that the keyboard cannot be operated in a dark site, thereby limiting the versatility of the keyboard.

SUMMARY OF THE INVENTION

The primary objective of the present invention is to provide a thin type light permeable keyboard, wherein the luminescence board may function as a luminous member that may mate with the light permeable frame board, elastic members and keys to indicate the sculptured characters, symbols, numbers or patterns on the keys, thereby facilitating the user operating the computer in the dark site.

In accordance with the present invention, there is provided a thin type light permeable keyboard, comprising: a plurality of keys, a plurality of bridge structures, a frame board, a luminescence board, a film circuit board, and a base board, wherein:

each of the light permeable keys is a light permeable press member, and has a top face in turn coated with a light permeable substrate layer, a light impermeable coating layer, and a light permeable protection layer, the light impermeable coating layer is sculptured with characters, symbols or patterns that may be exposed and may present a light permeable state;

each of the bridge structures includes a first frame, and a second frame pivoted with each other, each of the pivotable bridge structures is pivoted between each of the keys and the frame board, thereby forming a bridge type press button structure;

the frame board is a substantially rectangular light permeable frame board and is matingly pivoted with the bridge structures, the frame board is formed with a plurality of circular holes for passage of a plurality of elastic members, and each of the elastic members has a bottom end bonded on the luminescence board;

the luminescence board is a film-shaped luminous member that is mounted between the frame board and the film circuit board;

the film circuit board is mounted between the luminescence board and the base board; and the base board is used to support the frame board and the film circuit board.

Further benefits and advantages of the present invention will become apparent after a careful reading of the detailed description with appropriate reference to the accompanying drawings.

DETAILED DESCRIPTION OF THE INVENTION

Figure 1:
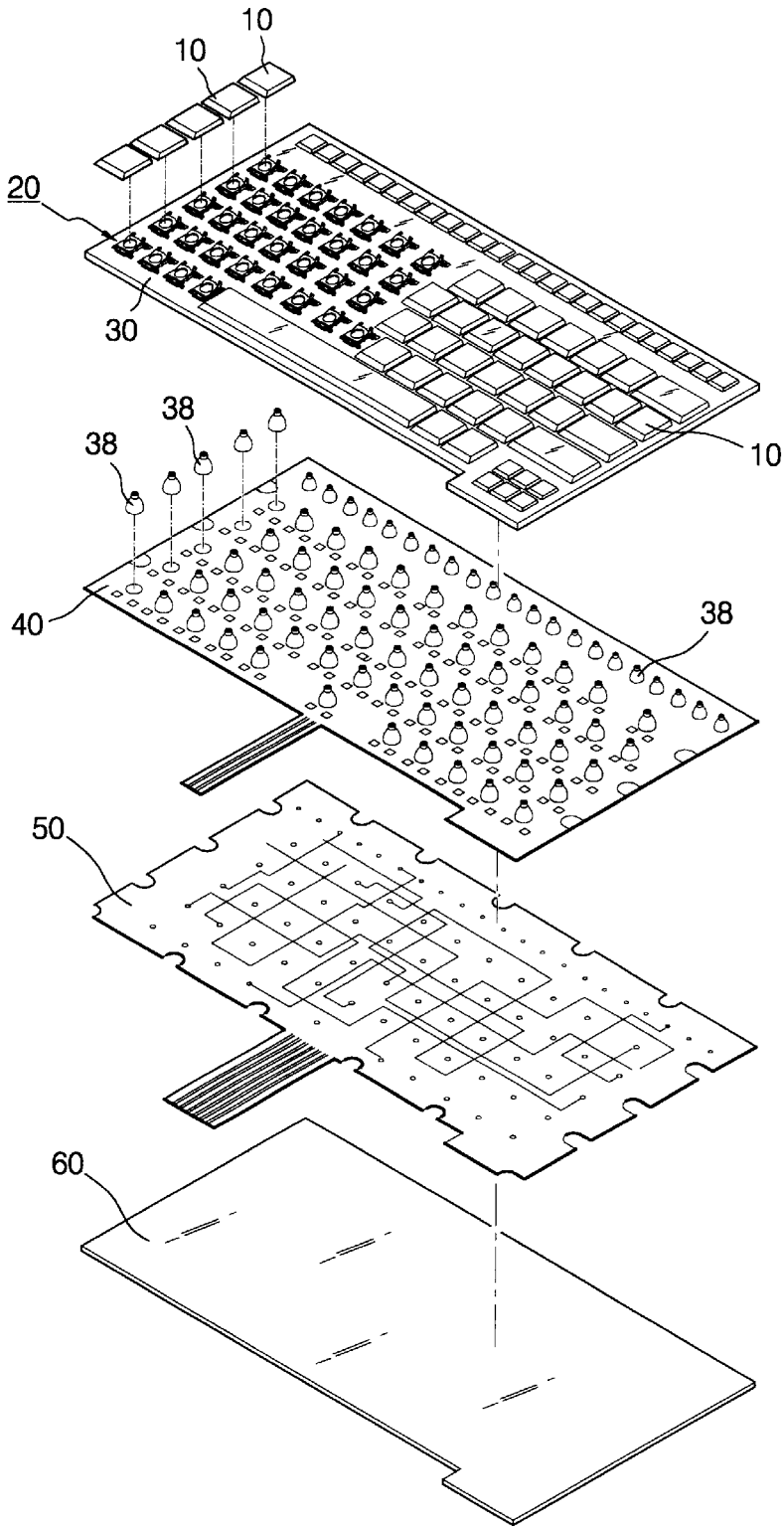
FIG. 1 is an exploded perspective view of a thin type light permeable keyboard in accordance with the present invention.
Figure 2:
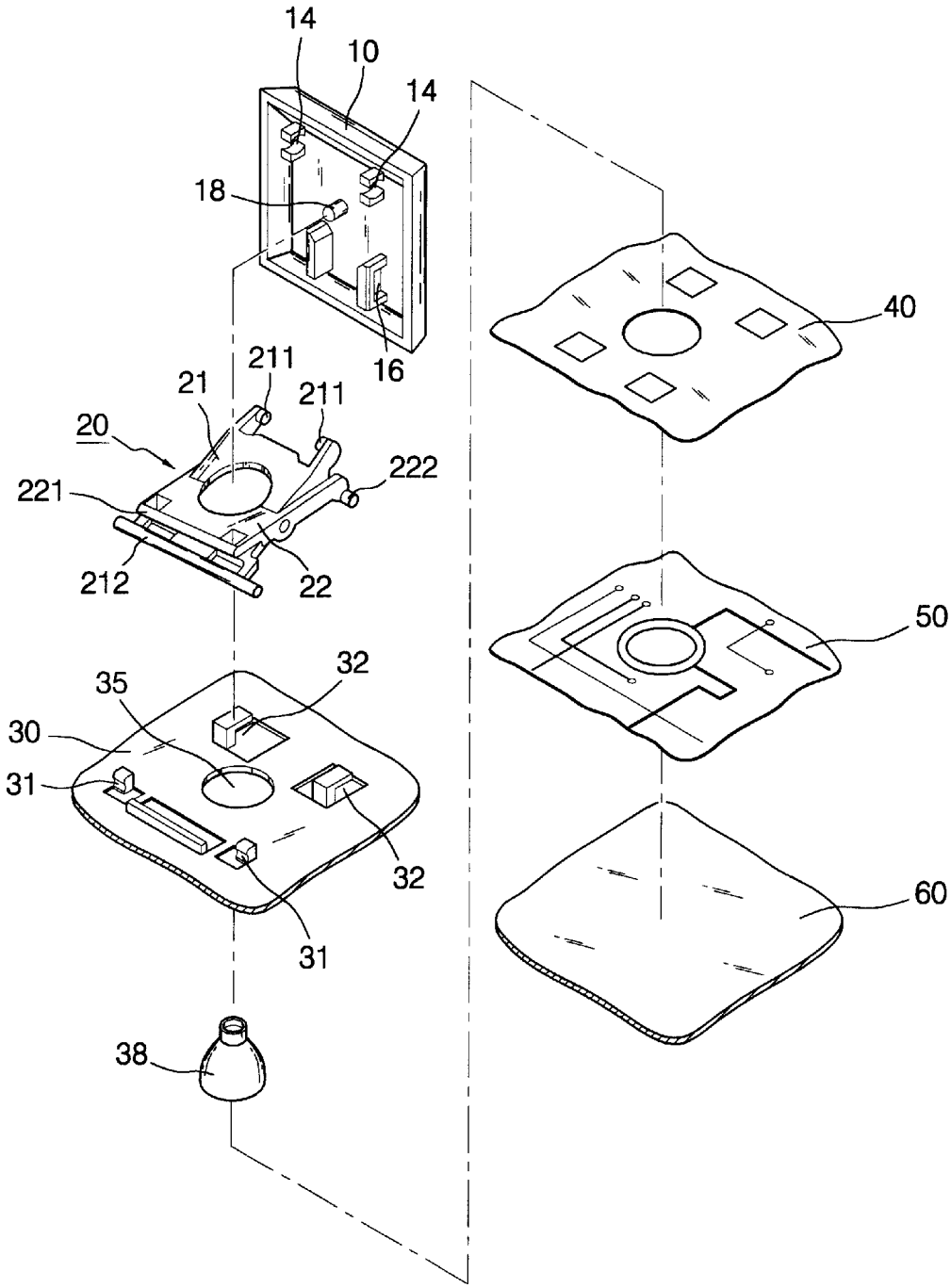
FIG. 2 is an enlarged exploded perspective view of the thin type light permeable keyboard in accordance with the present invention.
Figure 3:
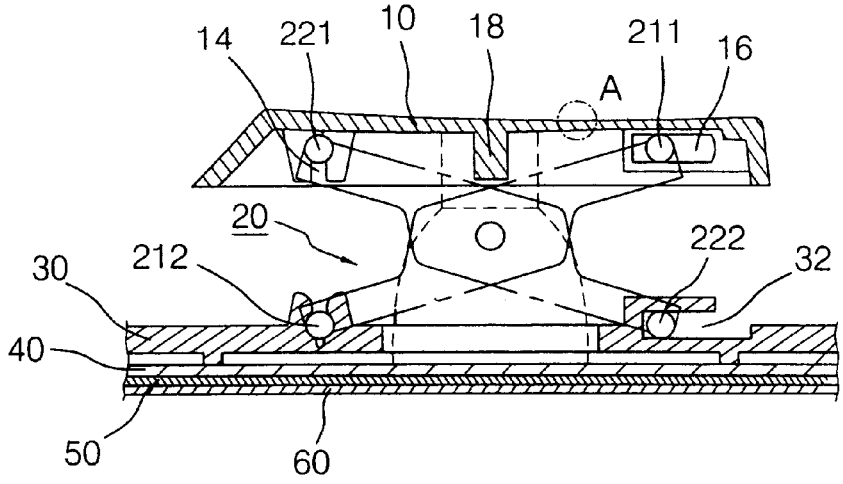
FIG. 3 is a plan cross-sectional assembly view of the thin type light permeable keyboard as shown in FIG. 2.

Referring to the drawings and initially to FIGS. 1–3, a thin type light permeable keyboard in accordance with a preferred embodiment of the present invention comprises a plurality of keys 10, a plurality of bridge structures 20, a frame board 30, a luminescence board 40, a film circuit board 50, and a base board 60.

Each of the keys 10 is a substantially square or rectangular light permeable press member. Each of the keys 10 has a bottom face formed with two opposite pivot grooves 14, and two opposite slide guide grooves 16. The bottom face of each of the keys 10 has a center position formed with a press portion 18. The two opposite pivot grooves 14 and the two opposite slide guide grooves 16 are pivoted on a top edge of the bridge structure 20.

Figure 4:
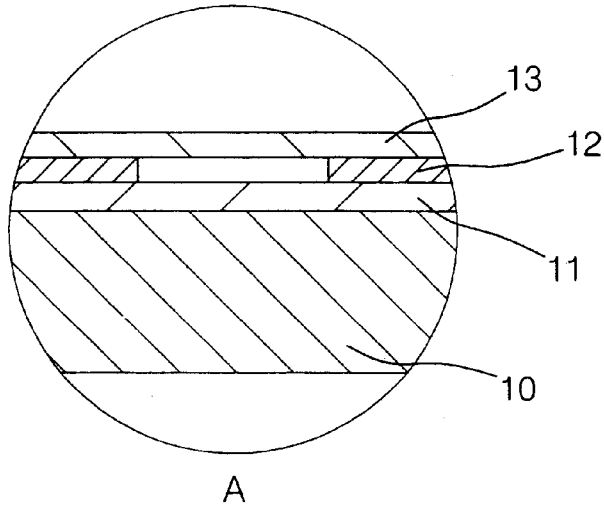
FIG. 4 is a locally enlarged view of the thin type light permeable keyboard as shown in FIG. 3.

As shown in FIG. 4, each of the light permeable keys 10 has a top face in turn coated with a light permeable substrate layer 11, a light impermeable coating layer 12 coated on a top face of the light permeable substrate layer 11, and a light permeable protection layer 13 coated on a top face of the light impermeable coating layer 12.

The light permeable substrate layer 11 is preferably a multi-color light permeable coating layer for allowing passage of light to indicate colored etched characters or symbols. The light impermeable coating layer 12 has a portion of shading coating that may be removed by the laser sculpture technology, so that the sculptured characters or symbols may be exposed and may present a light permeable state. The light permeable protection layer 13 may protect the sculptured characters, symbols or patterns.

As shown in FIGS. 2 and 3, each of the bridge structures 20 includes a first frame 21, and a second frame 22 pivoted with each other.

The first frame 21 of each of the bridge structures 20 has a top edge having two sides inwardly extended with two slide axles 211 which are slidably pivoted in the two opposite slide guide grooves 16 of each of the keys 10. The first frame 21 of each of the bridge structures 20 has a bottom edge formed with a pivot shaft 212.

The second frame 22 of each of the bridge structures 20 has a top edge formed with a pivot shaft 221 rotatably mounted in the two opposite pivot grooves 14 of each of the keys 10. The second frame 22 of each of the bridge structures 20 has a bottom edge having two sides outwardly extended with two slide axles 222.

The frame board 30 is a substantially rectangular light permeable frame board, and is matingly pivoted with multiple bridge structures 20 and multiple keys 10. The frame board 30 is provided with a plurality of opposite snapping grooves 31, and a plurality of inverted L-shaped opposite slide guide grooves 32.

The pivot shaft 212 of the first frame 21 of each of the bridge structures 20 is pivoted in the opposite snapping grooves 31 of the frame board 30. The two slide axles 222 of the second frame 22 of each of the bridge structures 20 are slidably mounted in the opposite slide guide grooves 32 of the frame board 30. Thus, each of the bridge structures 20 is pivoted between each of the keys 10 and the frame board 30, thereby forming a bridge type press button structure.

The frame board 30 is formed with a plurality of circular holes 35 for passage of a plurality of elastic members 38. Each of the elastic members 38 has a top end mounted on the press portion 18 of the bottom face of each of the keys 10, and a bottom end bonded on the luminescence board 40 by glue. Each of the hollow elastic members 38 contains a press post (not shown) that may be pressed downward to conduct the film circuit board 50. Thus, when each of the keys 10 is pressed downward, each of the elastic members 38 is pressed downward by the press portion 18 of each of the keys 10, so that the press post of each of the elastic members 38 is moved downward to touch the film circuit board 50, so as to connect and conduct the film circuit board 50. The operation of connecting and conducting the film circuit board 50 is conventional and will not be further described in detail. 18 of each of the keys 10, so that the press post of each of the elastic members 38 is moved downward to touch the film circuit board 50, so as to connect and conduct the film circuit board 50. The operation of connecting and conducting the film circuit board 50 is conventional and will not be further described in detail.

The luminescence board 40 is a film-shaped luminous member that is mounted between the frame board 30 and the film circuit board 50. The luminescence board 40 may be conducted by power supply to function as a light source, so that the light permeable frame board 30 and keys 10 may present a light permeable state, thereby indicating the sculptured characters, symbols or patterns on the keys 10.

The film circuit board 50 is mounted between the luminescence board 40 and the base board 60.

The base board 60 may be used to support the frame board 30 and the film circuit board 50.

Accordingly, the keyboard in accordance with the present invention is a luminous and light permeable thin type computer keyboard that may be used in the dark site. The thin type light permeable keyboard in accordance with a preferred embodiment of the present invention comprises a plurality of keys 10, a plurality of bridge structures 20, a frame board 30, a luminescence board 40, a film circuit board 50, and a base board 60.

Each of the light permeable keys 10 has a top face in turn coated with a light permeable substrate layer 11, a light impermeable coating layer 12, and a light permeable protection layer 13. The light impermeable coating layer 12 is sculptured with characters, symbols or patterns that may be exposed and may present a light permeable state.

Each of the pivotable bridge structures 20 is pivoted between each of the keys 10 and the frame board 30, thereby forming a bridge type press button structure.

The frame board 30 is matingly pivoted with multiple bridge structures 20, and multiple light permeable elastic members 38.

The luminescence board 40 is a film-shaped luminous member that is mounted between the frame board 30 and the film circuit board 50. The luminescence board 40 may be conducted by power supply to function as a light source, so that the light permeable frame board 30, elastic members 38 and keys 10 may be adapted to present a light permeable state, thereby clearly indicating the sculptured characters, symbols, numbers or patterns on the keys 10.

Thus, the thin type light permeable keyboard in accordance with the present invention is a luminous and light permeable thin type computer keyboard that may be used in the dark site, thereby facilitating the user operating the computer in the dark site.

In conclusion, the thin type light permeable keyboard in accordance with a preferred embodiment of the present invention is provided with a luminescence board that may function as a luminous member that may mate with the light permeable frame board, elastic members and keys to indicate the sculptured characters, symbols, numbers or patterns on the keys, thereby facilitating the user operating the computer in the dark site.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A thin type light permeable keyboard, comprising: a plurality of keys, a plurality of bridge structures, a frame board, a luminescence board, a film circuit board, and a base board, wherein:

each of the light permeable keys is a light permeable press member, and has a top face in turn coated with a light permeable substrate layer, a light impermeable coating layer, and a light permeable protection layer, the light impermeable coating layer is sculptured with characters, symbols or patterns that is exposed and presents a light permeable state;

each of the bridge structures includes a first frame, and a second frame pivoted with each other, each of the pivotable bridge structures is pivoted between each of the keys and the frame board, thereby forming a bridge type press button structure;

the frame board is a substantially rectangular light permeable frame board and is matingly pivoted with the bridge structures, the frame board is formed with a plurality of circular holes for passage of a plurality of elastic members, and each of the elastic members has a bottom end bonded on the luminescence board;

the luminescence board is a film-shaped luminous member that is mounted between the frame board and the film circuit board;

the film circuit board is mounted between the luminescence board and the base board; and the base board is used to support the frame board and the film circuit board.

2. The thin type light permeable keyboard in accordance with claim 1, wherein each of the keys has a bottom face formed with two opposite pivot grooves, and two opposite slide guide grooves, the bottom face of each of the keys has a center position formed with a press portion.

3. The thin type light permeable keyboard in accordance with claim 1, wherein the light permeable substrate layer is a multi-color light permeable coating layer for allowing passage of light to indicate colored characters or symbols.

4. The thin type light permeable keyboard in accordance with claim 2, wherein the first frame of each of the bridge structures has a top edge having two sides inwardly extended with two slide axles which are slidably pivoted in the two opposite slide guide grooves of each of the keys, and the second frame of each of the bridge structures has a top edge formed with a pivot shaft rotatably mounted in the two opposite pivot grooves of each of the keys.

5. The thin type light permeable keyboard in accordance with claim 1, wherein each of the bridge structures has a bottom edge pivoted on the frame board.

6. The thin type light permeable keyboard in accordance with claim 5, wherein the frame board is provided with a plurality of opposite snapping grooves, and a plurality of inverted L-shaped opposite slide guide grooves, the first frame of each of the bridge structures has a bottom edge formed with a pivot shaft that is pivoted in the opposite snapping grooves of the frame board, and the second frame of each of the bridge structures has a bottom edge having two sides outwardly extended with two slide axles slidably mounted in the opposite slide guide grooves of the frame board.

7. The thin type light permeable keyboard in accordance with claim 2, wherein each of the elastic members has a top end mounted on the press portion of the bottom face of each of the keys.

* * * * *